US011646535B2

(12) United States Patent
Lin

(10) Patent No.: US 11,646,535 B2
(45) Date of Patent: May 9, 2023

(54) TERMINAL MODULE FOR EASY DETERMINATION OF ELECTRICAL PERFORMANCE AND BACKPLANE CONNECTOR THEREOF

(71) Applicant: DONGGUAN LUXSHARE TECHNOLOGIES CO., LTD, Dongguan (CN)

(72) Inventor: Yanbo Lin, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 79 days.

(21) Appl. No.: 17/355,576

(22) Filed: Jun. 23, 2021

(65) Prior Publication Data

US 2022/0094116 A1 Mar. 24, 2022

(30) Foreign Application Priority Data

Sep. 21, 2020 (CN) ..... 202022085168.0

(51) Int. Cl.
*H01R 13/6597* (2011.01)
*H01R 13/6581* (2011.01)
*H01R 13/405* (2006.01)

(52) U.S. Cl.
CPC ..... *H01R 13/6597* (2013.01); *H01R 13/405* (2013.01); *H01R 13/6581* (2013.01)

(58) Field of Classification Search
CPC ..... H01R 13/6597; H01R 13/405; H01R 13/6581
USPC ..... 439/607.02
See application file for complete search history.

(56) References Cited

U.S. PATENT DOCUMENTS 6,551,140 B2 * 4/2003 Billman ..... H01R 13/6471 439/607.07
6,843,687 B2 * 1/2005 McGowan ..... H01R 13/502 439/607.06
7,604,490 B2 * 10/2009 Chen ..... H01R 13/6471 439/541.5
7,883,367 B1 * 2/2011 Kline ..... H01R 13/6587 439/607.05

(Continued)

FOREIGN PATENT DOCUMENTS

CN 102255180 A * 11/2011 ..... H01R 12/585
CN 103094784 A * 5/2013 ..... H01R 13/6471

(Continued)

*Primary Examiner* — Peter G Leigh
(74) *Attorney, Agent, or Firm* — Birch, Stewart, Kolasch & Birch, LLP

(57) ABSTRACT

A terminal module includes an insulating member, a number of conductive terminals, and a conductive plastic. Each conductive terminal includes a fixing portion. The conductive terminals include a group of signal terminals, a first ground terminal and a second ground terminal. The terminal module includes a first rib, a second rib and a groove. The first rib is adjacent to but not in contact with the fixing portion of the first ground terminal. The second rib is adjacent to but not in contact with the fixing portion of the second ground terminal. The present disclosure also relates to a backplane connector having the terminal module. Compared with the prior art, by making the first ground terminal and the second ground terminal non-conducting, it easier to determine the accuracy of the electrical test.

15 Claims, 13 Drawing Sheets

(56) References Cited

U.S. PATENT DOCUMENTS

| | | | | |
|---|---|---|---|---|
| 7,931,500 | B2 * | 4/2011 | Knaub | H01R 13/6587 439/607.07 |
| 7,967,637 | B2 * | 6/2011 | Fedder | H01R 13/6587 439/607.06 |
| 8,157,591 | B2 * | 4/2012 | Fedder | H01R 13/514 439/108 |
| 8,187,034 | B2 * | 5/2012 | Fedder | H01R 13/6599 439/941 |
| 8,616,919 | B2 * | 12/2013 | Stoner | H01R 13/6587 439/607.07 |
| 8,764,488 | B2 * | 7/2014 | Zeng | H01R 13/6585 439/108 |
| 9,537,239 | B1 * | 1/2017 | Liu | H01R 13/6587 |
| 9,685,738 | B2 * | 6/2017 | Laurx | H01R 13/6585 |
| 10,693,249 | B2 * | 6/2020 | Toh | H01R 13/6587 |
| 2002/0168898 | A1 * | 11/2002 | Billman | H01R 13/6471 439/607.07 |
| 2011/0021082 | A1 * | 1/2011 | Kline | H01R 12/724 439/660 |
| 2017/0264053 | A1 * | 9/2017 | Laurx | H01R 13/652 |
| 2020/0059032 | A1 * | 2/2020 | Long | H01R 13/6461 |
| 2020/0176934 | A1 * | 6/2020 | Trout | H01R 13/6587 |
| 2020/0212636 | A1 * | 7/2020 | Chang | H01R 13/6474 |

FOREIGN PATENT DOCUMENTS

| | | | | | |
|---|---|---|---|---|---|
| CN | 103151627 | A | * | 6/2013 | H01R 13/6587 |
| CN | 110707454 | A | * | 1/2020 | |
| CN | 111370915 | A | * | 7/2020 | H01R 12/57 |
| CN | 111370943 | A | * | 7/2020 | |
| EP | 1619758 | A2 | * | 1/2006 | H01R 12/725 |

* cited by examiner

TERMINAL MODULE FOR EASY DETERMINATION OF ELECTRICAL PERFORMANCE AND BACKPLANE CONNECTOR THEREOF

CROSS-REFERENCE TO RELATED APPLICATION

This patent application claims priority of a Chinese Patent Application No. 202022085168.0, filed on Sep. 21, 2020 and titled "TERMINAL MODULE AND BACKPLANE CONNECTOR", the entire content of which is incorporated herein by reference.

TECHNICAL FIELD

The present disclosure relates to a terminal module and a backplane connector, which belongs to a technical field of high-frequency/high-speed connectors.

BACKGROUND

An existing backplane connector usually includes a plurality of terminal modules disposed side by side. Each terminal module usually includes signal terminals, ground terminals, and a conductive plastic beside the signal terminals and the ground terminals. In general, the backplane connector has higher requirements for signal transmission quality during data transmission. In order to achieve better shielding performance, the conductive plastic is usually designed to be in contact with the ground terminals. By this design, all the ground terminals are connected as a whole through the conductive plastic, which increases the shielding area.

When the backplane connector leaves the factory, electrical tests (for example, high voltage test, short/open circuit test, etc.) are necessary tests. As mentioned above, if the conductive plastic is brought into contact with the ground terminals, theoretically, the multiple ground terminals are connected to each other under the transmission of the conductive plastic. However, because the conductive plastic and the ground terminals are made of different materials, the conductivity of the conductive plastic is usually much lower than that of ordinary metal parts, which may cause non-conduction even if the conductive plastic completely contacts the ground terminals. This kind of existing design will sometimes conduct and not conduct during electrical testing, so that it is difficult to determine whether the product is qualified when testing the electrical performance.

SUMMARY

An object of the present disclosure is to provide a terminal module which is easy to determine the electrical performance and a backplane connector having the terminal module.

In order to achieve the above object, the present disclosure adopts the following technical solution: a terminal module, including: an insulating member including a mating surface and a mounting surface; a plurality of conductive terminals, each conductive terminal including a fixing portion fixed to the insulating member, a mating portion extending beyond the mating surface, and a mounting foot extending beyond the mounting surface, the plurality of conductive terminals including at least a group of signal terminals, a first ground terminal and a second ground terminal, wherein the first ground terminal and the second ground terminal are both adjacent to the group of signal terminals, and wherein the group of signal terminals are located between the first ground terminal and the second ground terminal; and a conductive plastic mounted to the insulating member; wherein the terminal module includes a first rib, a second rib, and a groove located between the first rib and the second rib; the first rib corresponds to the fixing portion of the first ground terminal, the second rib corresponds to the fixing portion of the second ground terminal, the groove corresponds to the fixing portions of the group of signal terminals; the first rib is adjacent to the fixing portion of the first ground terminal but not in contact with the fixing portion of the first ground terminal; and the second rib is adjacent to the fixing portion of the second ground terminal but not in contact with the fixing portion of the second ground terminal.

In order to achieve the above object, the present disclosure adopts the following technical solution: a terminal module, including: an insulating member; a plurality of conductive terminals, each conductive terminal including a fixing portion fixed to the insulating member and a mating portion extending beyond the insulating member, the plurality of conductive terminals including a group of signal terminals, a first ground terminal and a second ground terminal, wherein the first ground terminal and the second ground terminal are both adjacent to the group of signal terminals, and wherein the group of signal terminals are located between the first ground terminal and the second ground terminal; and a conductive plastic mounted to the insulating member; wherein the terminal module includes a first rib, a second rib, and a groove located between the first rib and the second rib; the first rib corresponds to the fixing portion of the first ground terminal, the second rib corresponds to the fixing portion of the second ground terminal, the groove corresponds to the fixing portions of the group of signal terminals; the first rib is so adjacent to but not in contact with the fixing portion of the first ground terminal that coupling is capable of occurring; and the second rib is so adjacent to but not in contact with the fixing portion of the second ground terminal that coupling is capable of occurring.

In order to achieve the above object, the present disclosure adopts the following technical solution: a backplane connector, including: an insulating portion; and a plurality of terminal modules, each terminal module including: an insulating member including a mating surface and a mounting surface; a plurality of conductive terminals, each conductive terminal including a fixing portion fixed to the insulating member, a mating portion extending beyond the mating surface, and a mounting foot extending beyond the mounting surface, the plurality of conductive terminals including at least a group of signal terminals, a first ground terminal and a second ground terminal, wherein the first ground terminal and the second ground terminal are both adjacent to the group of signal terminals, and wherein the group of signal terminals are located between the first ground terminal and the second ground terminal; and a conductive plastic mounted to the insulating member; wherein each terminal module includes a first rib, a second rib, and a groove located between the first rib and the second rib; the first rib corresponds to the fixing portion of the first ground terminal, the second rib corresponds to the fixing portion of the second ground terminal, the groove corresponds to the fixing portions of the group of signal terminals; the first rib is adjacent to the fixing portion of the first ground terminal but not in contact with the fixing portion of the first ground terminal; and the second rib is adjacent to the fixing portion of the second ground terminal but not in contact with the fixing portion of the second ground terminal; and wherein the insulating portion defines a plurality of receiving grooves to receive the mating portions, and two adjacent terminal modules are symmetrically disposed along a plane located between the two adjacent terminal modules.

Compared with the prior art, in the present disclosure, the first rib is adjacent to the fixing portion of the first ground terminal but not in contact with the fixing portion of the first ground terminal, and the second rib is adjacent to the first ground terminal but not in contact with the fixing portion of the second ground terminal. As a result, on one hand, the conductive plastic can play a positive role in shielding the terminals; on the other hand, by making the first ground terminal and the second ground terminal non-conducting, it is convenient to determine the accuracy of the electrical test.

DETAILED DESCRIPTION

Figure 1:
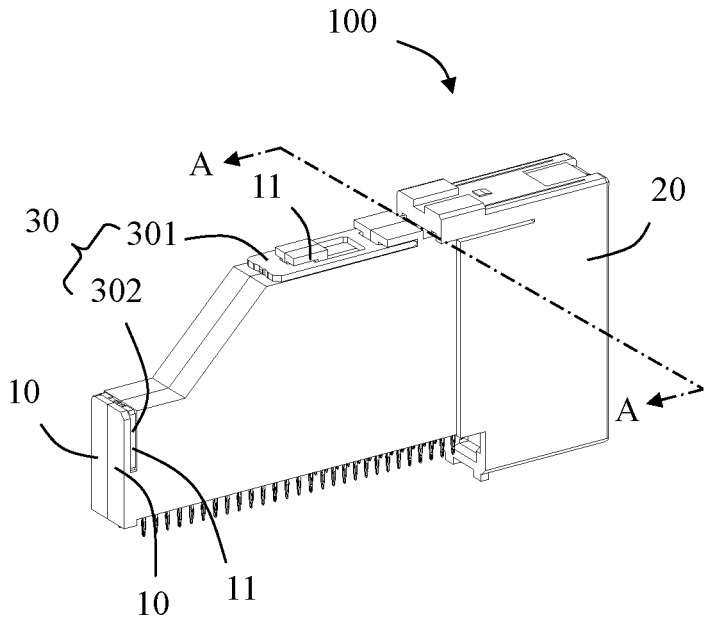
FIG. 1 is a perspective view of a backplane connector in accordance with an embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 2:
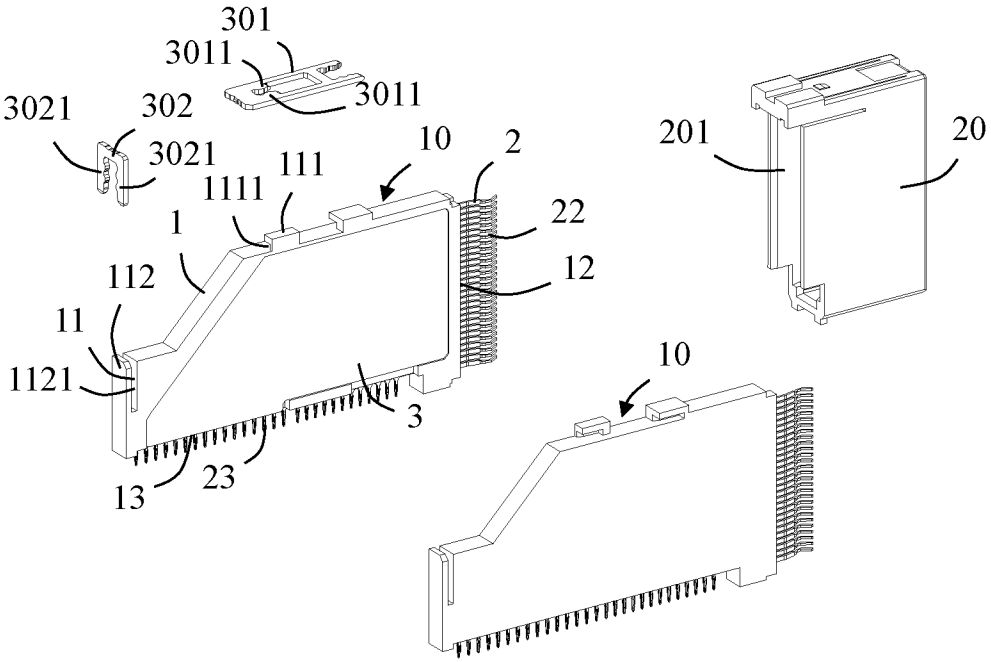
FIG. 2 is a partially exploded perspective view of FIG. 1.
Figure 3:
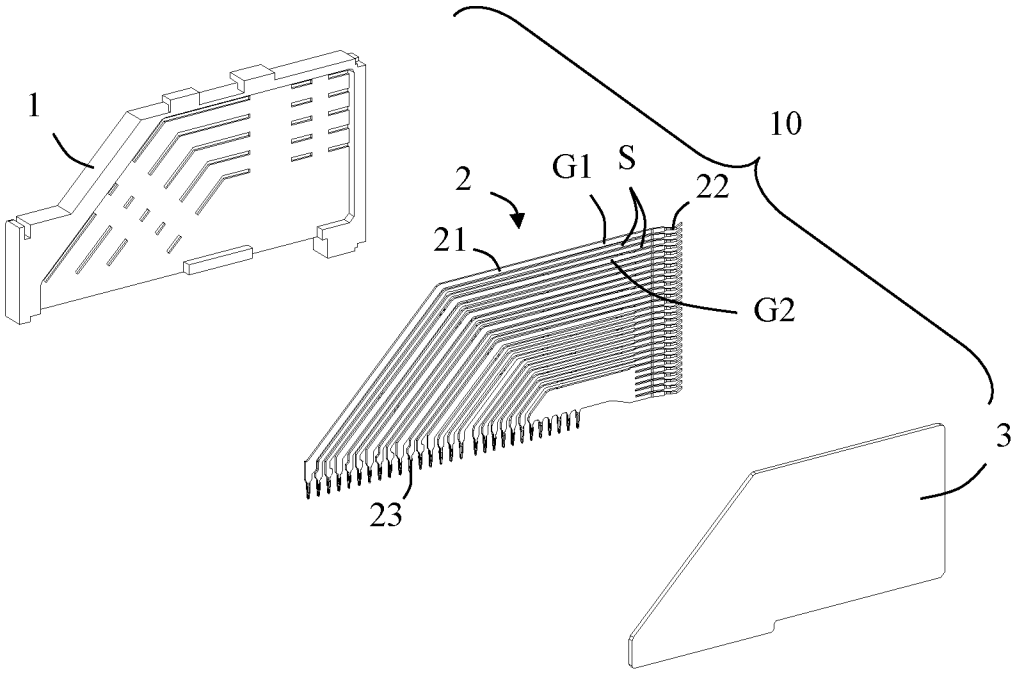
FIG. 3 is a partial perspective exploded view of a terminal module of the backplane connector in the first embodiment of the present disclosure.
Figure 4:
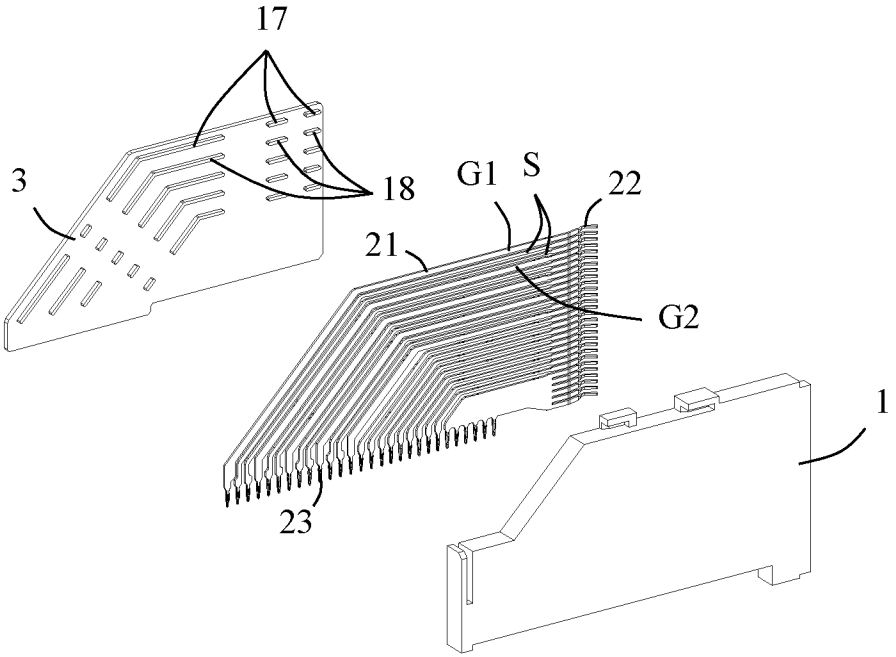
FIG. 4 is a perspective exploded view of another terminal module.
Figure 5:
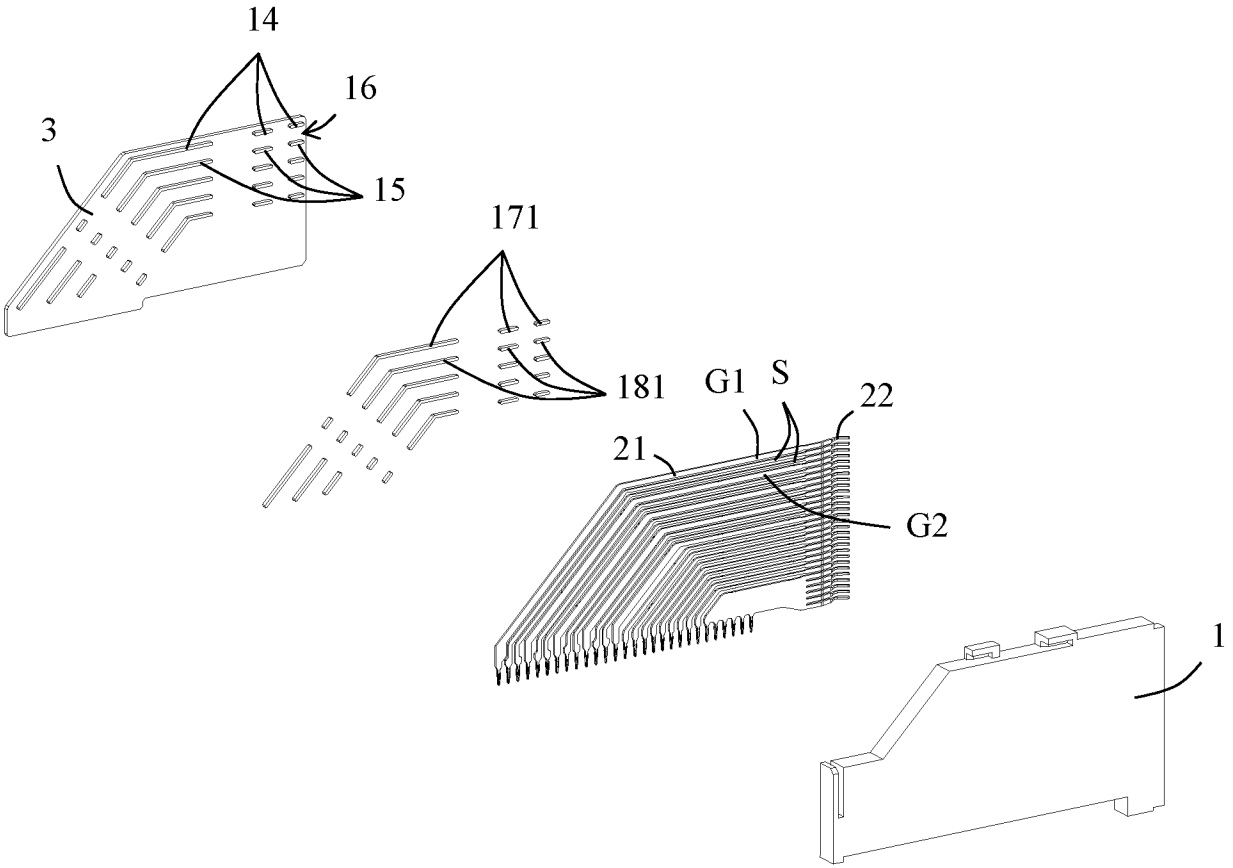
FIG. 5 is a further perspective exploded view of FIG. 4.
Figure 6:
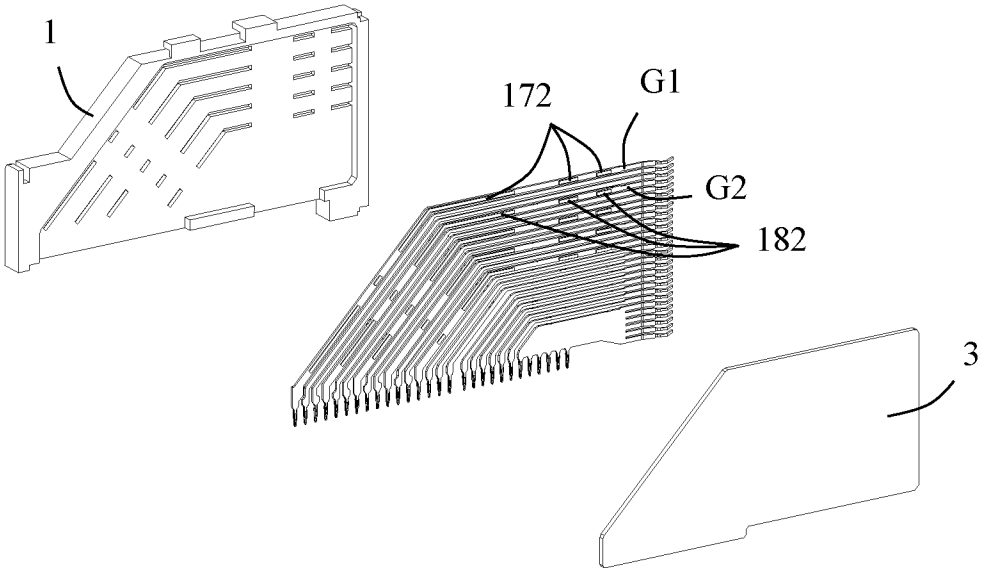
FIG. 6 is a partial perspective exploded view of the terminal module of the backplane connector in accordance with a second embodiment of the present disclosure.
Figure 7:
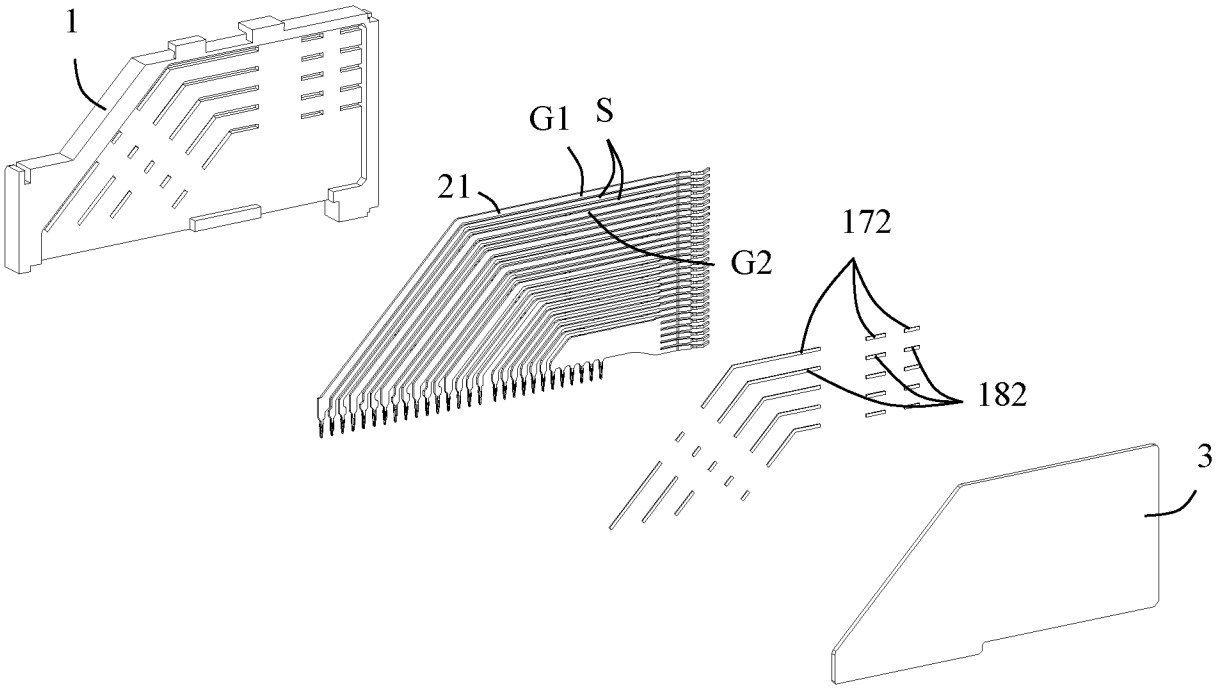
FIG. 7 is a further perspective exploded view of FIG. 6.

Referring to FIGS. 1 and 2, the present disclosure discloses a backplane connector 100 including an insulating portion 20, a plurality of terminal modules 10, and a holding piece 30 connecting the terminal modules 10 as a whole. The insulating portion 20 defines a receiving groove 201 for receiving parts of the terminal modules 10. Each terminal module 10 includes an insulating member 1, a plurality of conductive terminals 2 fixed to the insulating member 1, and a conductive plastic 3 mounted to the insulating member 1. In an embodiment of the present disclosure, two adjacent terminal modules 10 are disposed symmetrically along a plane located between the two adjacent terminal modules 10. In the following, only one terminal module 10 is taken as an example for description.

Each insulating member 1 includes at least one holding portion 11. The holding piece 30 is used to fix the holding portions 11 of all the terminal modules 10. The holding portion 11 may be a protrusion and/or a groove. In the illustrated embodiment of the present disclosure, the holding portion 11 includes a first holding portion 111 located at a top of the insulating member 1 and a second holding portion 112 located at a rear end of the insulating member 1. Correspondingly, the holding piece 30 includes a first holding piece 301 that is matched with the first holding portion 111 and a second holding piece 302 that is matched with the second holding portion 112. Referring to FIGS. 1 and 2, in the illustrated embodiment of the present disclosure, a bottom of the first holding portion 111 defines a first holding groove 1111. The first holding piece 301 includes a first protruding piece portion 3011 inserted into the first holding groove 1111. The second holding portion 112 includes a second holding groove 1121. The second holding piece 302 includes a second protruding piece portion 3021 inserted into the second holding groove 1121.

The insulating member 1 is made of insulating material, and includes h a mating surface 12 and a mounting surface 13. The mating surface 12 is substantially perpendicular to the mounting surface 13.

In an embodiment of the present disclosure, the plurality of conductive terminals 2 are insert-molded with the insulating member 1. From a structural point of view, each conductive terminal 2 includes a fixing portion 21 fixed to the insulating member 1, a mating portion 22 extending beyond the mating surface 12 and a mounting foot 23 extending beyond the mounting surface 13. The mating portion 22 is received in the receiving groove 201 of the insulating portion 20 to mate with a mating connector (not shown). The mounting foot 23 is used for electrical connection with a circuit board (not shown). From a functional point of view, the plurality of conductive terminals 2 include at least a group of signal terminals S, a first ground terminal G1 and a second ground terminal G2. The first ground terminal G1 and the second ground terminal G2 are both adjacent to the group of signal terminals S. The group of signal terminals S are located between the first ground terminal G1 and the second ground terminal G2. This layout can improve the shielding effect on the signal terminals and improve the quality of data transmission.

The terminal module 10 includes a first rib 14, a second rib 15 and a groove 16 located between the first rib 14 and the second rib 15. The first rib 14 corresponds to the fixing portion 21 of the first ground terminal G1. The second rib 15 corresponds to the fixing portion 21 of the second ground terminal G2. The groove 16 corresponds to the fixing portions 21 of the group of signal terminals S. The first rib 14 is adjacent to the fixing portion 21 of the first ground terminal G1 but not in contact with the fixing portion 21 of the first ground terminal G1. The second rib 15 is adjacent to the fixing portion 21 of the second ground terminal G2 but not in contact with the fixing portion 21 of the second ground terminal G2. In some embodiments, the first rib 14 is so adjacent to the fixing portion 21 of the first ground terminal G1 that coupling is capable of occurring, which is beneficial to improve the shielding effect on the signal terminals and improve the quality of data transmission. Similarly, the second rib 15 is so adjacent to the fixing portion 21 of the second ground terminal G2 that coupling is capable of occurring.

Referring to FIGS. 3 to 7, in some embodiments of the present disclosure, the first rib 14 and the second rib 15 are disposed on the conductive plastic 3. For example, the first rib 14 and the second rib 15 are integrally formed with the conductive plastic 3. Both the fixing portion 21 of the first ground terminal G1 and the fixing portion 21 of the second ground terminal G2 are at least partially exposed to the insulating member 1. The terminal module 10 includes a first isolation portion 17 between the first rib 14 and the fixing portion 21 of the first ground terminal G1, and a second isolation portion 18 located between the second rib 15 and the fixing portion 21 of the second ground terminal G2.

Referring to FIGS. 3 to 5, 10 and 11, in the first embodiment of the present disclosure, the first isolation portion 17 includes a first non-conductive coating 171 disposed on the first rib 14, and the second isolation portion 18 includes a second non-conductive coating 181 disposed on the second rib 15. Of course, in other alternative embodiments, the first non-conductive coating 171 and the second non-conductive coating 181 may also be disposed on the fixing portion 21 of the first ground terminal G1 and the fixing portion 21 of the second ground terminal G2, respectively. In an embodiment of the present disclosure, the first non-conductive coating 171 and the second non-conductive coating 181 are both silk-screened coatings. A plurality of first ribs 14 are provided and discontinuously disposed along an extension direction of the fixing portion 21 of the first ground terminal G1. A plurality of second ribs 15 are provided and discontinuously disposed along an extension direction of the fixing portion 21 of the second ground terminal G2. This arrangement facilitates the molding of the first rib 14 and the second rib 15.

Referring to FIGS. 6, 7, 10 and 11, in a second embodiment of the present disclosure, the first isolation portion 17 includes a first non-conductive film 172 pasted on the fixing portion 21 of the first ground terminal G1, and the second isolation portion 18 includes a second non-conductive film 182 pasted on the fixing portion 21 of the second ground terminal G2. It can be understood that in other alternative embodiments, the first isolation portion 17 may also include a first non-conductive film 172 pasted on the first rib 14, and the second isolation portion 18 may also include a second non-conductive film 182 pasted on the second rib 15. In some embodiments, the first non-conductive film 172 and the second non-conductive film 182 may be polyester films. In other alternative embodiments, the first non-conductive film 172 can also be replaced by a first insulating block, and the second non-conductive film 182 can also be replaced by a second insulating block.

Figure 8:
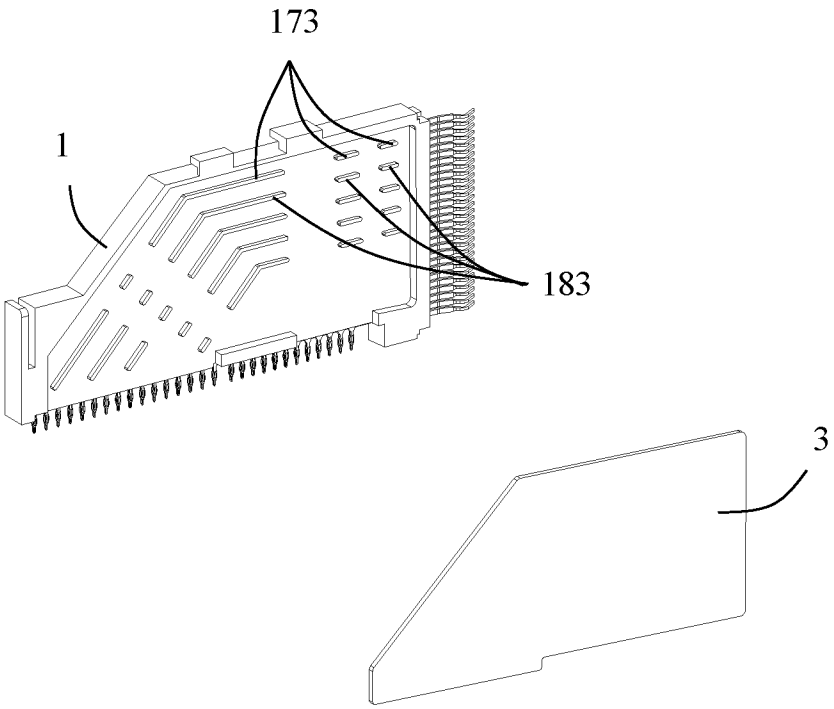
FIG. 8 is a partial perspective exploded view of the terminal module of the backplane connector in accordance with a third embodiment of the present disclosure.
Figure 12:
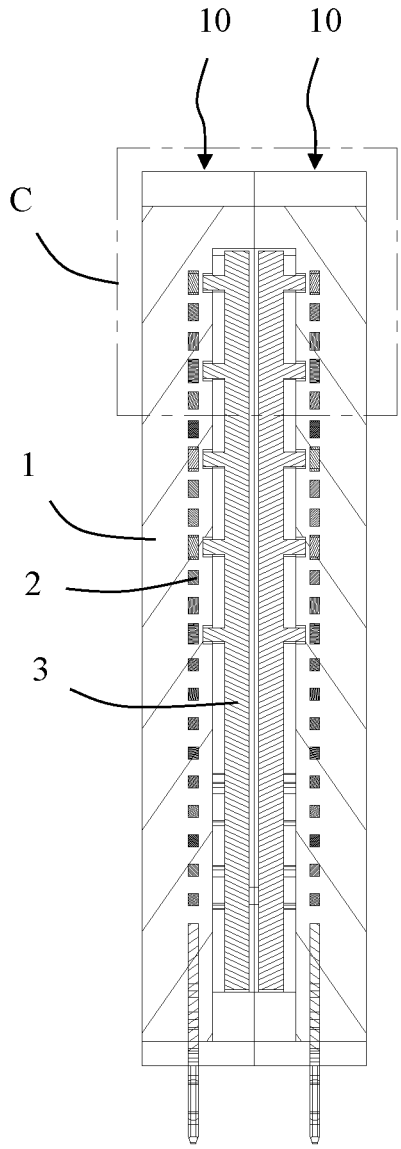
FIG. 12 is a schematic cross-sectional view taken along line A-A in FIG. 1 and taking the third embodiment as an example.
Figure 13:
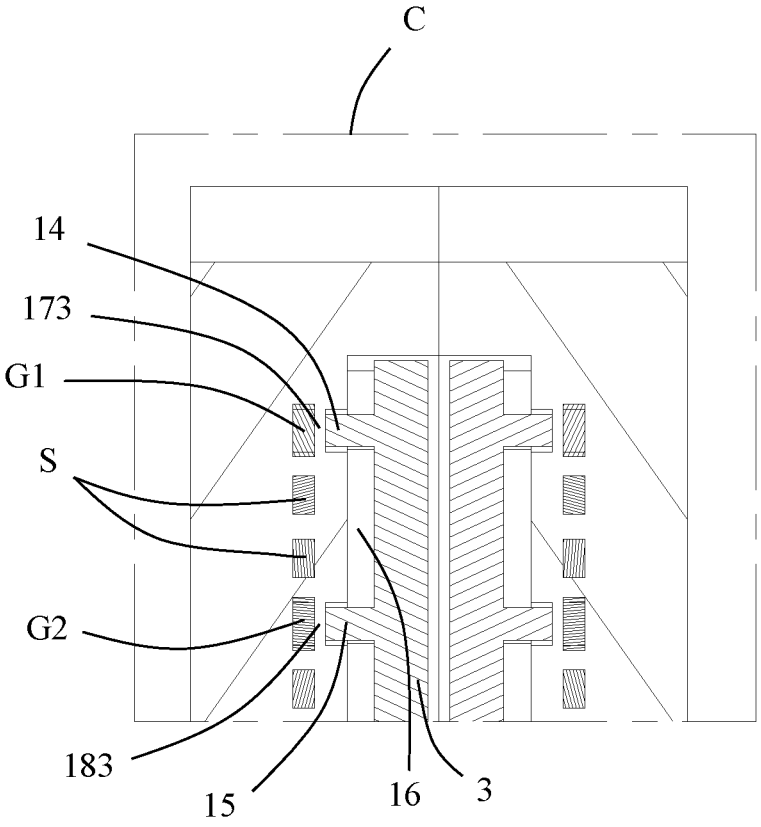
FIG. 13 is a partial enlarged view of a frame portion C in FIG. 12.

Referring to FIGS. 8, 12 and 13, in a third embodiment of the present disclosure, the first isolation portion 17 includes a first non-conductive isolation portion 173 disposed between the first ground terminal G1 and the first rib 14, and the second isolation portion 18 includes a second non-conductive isolation portion 183 disposed between the second ground terminal G2 and the second rib 15. The first non-conductive isolation portion 173 and the second non-conductive isolation portion 183 are integrally formed with the insulating member 1.

Figure 9:
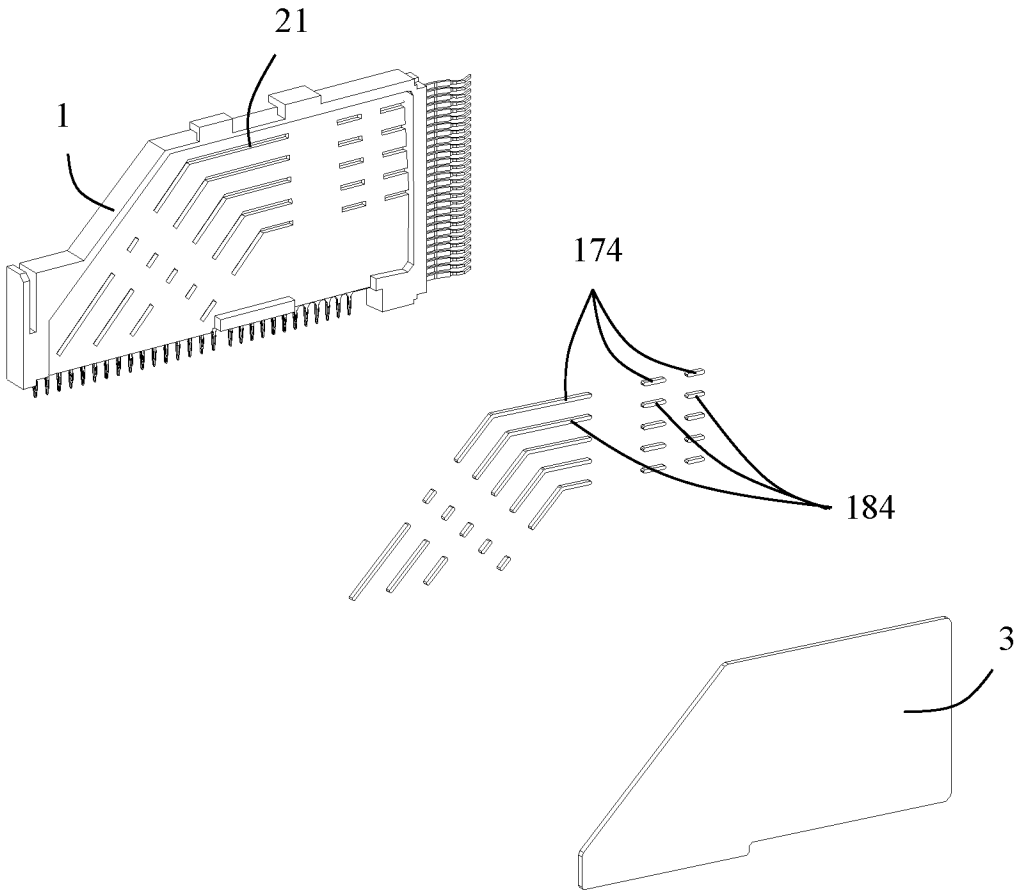
FIG. 9 is a partial perspective exploded view of the terminal module of the backplane connector in accordance with a fourth embodiment of the present disclosure.
Figure 10:
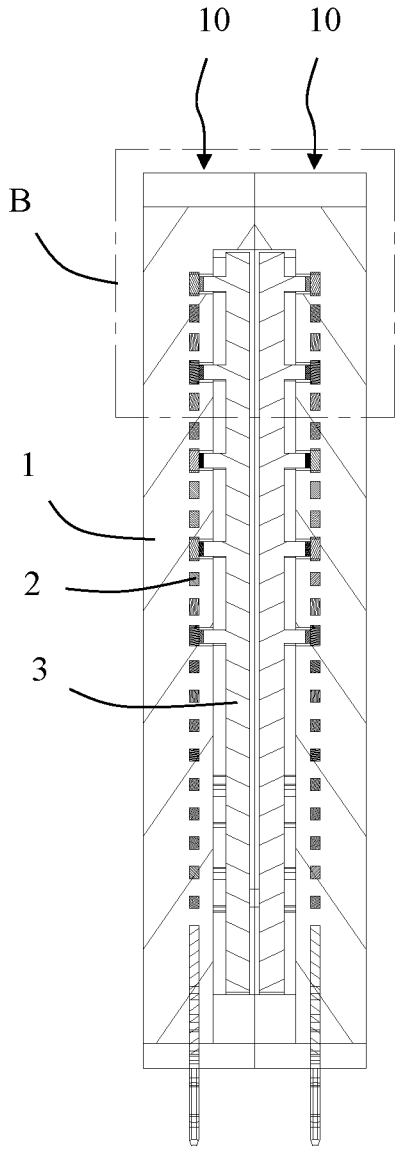
FIG. 10 is a schematic cross-sectional view taken along line A-A in FIG. 1 and taking the first embodiment, the second embodiment or the fourth embodiment as an example.
Figure 11:
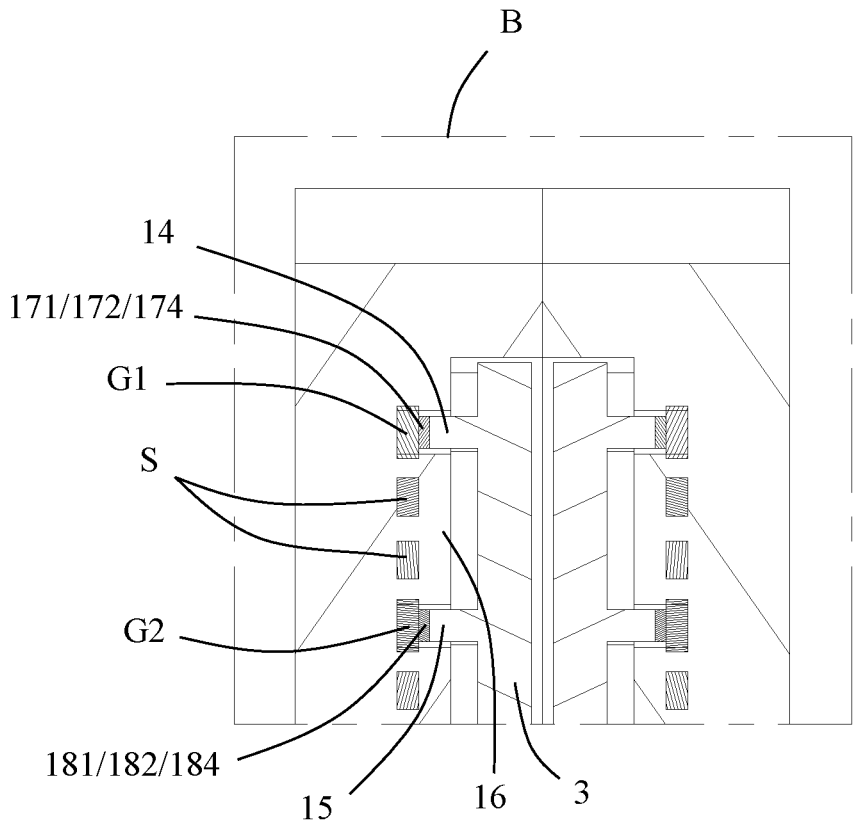
FIG. 11 is a partial enlarged view of a frame portion B in FIG. 10.

Referring to FIGS. 9, 11 and 12, in a fourth embodiment of the present disclosure, both the fixing portion 21 of the first ground terminal G1 and the fixing portion 21 of the second ground terminal G2 are at least partially exposed to the insulating member 1. The first isolation portion 17 includes a first non-conductive isolation member 174 disposed on the fixing portion 21 of the first ground terminal G1. The second isolation portion 18 includes a second non-conductive isolation member 184 disposed on the fixing portion 21 of the second ground terminal G2. In some embodiments, the first non-conductive spacer 174 and the second non-conductive spacer 184 may be integrally formed with the fixing portion 21 of the first ground terminal G1 and the fixing portion 21 of the second ground terminal G2, respectively.

Compared with the prior art, in the present disclosure, the first rib 14 is adjacent to the fixing portion 21 of the first ground terminal G1 but not in contact with the fixing portion 21 of the first ground terminal G1, and the second rib 15 is adjacent to the fixing portion 21 of the second ground terminal G2 but not in contact with the fixing portion 21 of the second ground terminal G2. With this arrangement, on one hand, the conductive plastic 3 can play a positive role in terminal shielding; on the other hand, the first ground terminal G1 and the second ground terminal G2 are not conducted, thereby facilitating the judgment of the accuracy of the electrical test.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A terminal module, comprising:

an insulating member comprising a mating surface and a mounting surface;

a plurality of conductive terminals, each conductive terminal comprising a fixing portion fixed to the insulating member, a mating portion extending beyond the mating surface, and a mounting foot extending beyond the mounting surface, the plurality of conductive terminals comprising at least a group of signal terminals, a first ground terminal and a second ground terminal, wherein the first ground terminal and the second ground terminal are both adjacent to the group of signal terminals, and wherein the group of signal terminals are located between the first ground terminal and the second ground terminal; and a conductive plastic mounted to the insulating member;

wherein the terminal module comprises a first rib, a second rib, and a groove located between the first rib and the second rib; the first rib corresponds to the fixing portion of the first ground terminal, the second rib corresponds to the fixing portion of the second ground terminal, the groove corresponds to the fixing portions of the group of signal terminals; the first rib is adjacent to the fixing portion of the first ground terminal but not in contact with the fixing portion of the first ground terminal; and the second rib is adjacent to the fixing portion of the second ground terminal but not in contact with the fixing portion of the second ground terminal;

wherein the first rib and the second rib are provided on the conductive plastic; and wherein the fixing portion of the first ground terminal and the fixing portion of the second ground terminal are both at least partly exposed to the insulating member; the terminal module comprises a first isolation portion located between the first rib and the fixing portion of the first ground terminal, and a second isolation portion located between the second rib and the fixing portion of the second ground terminal.

2. The terminal module according to claim 1, wherein the first isolation portion comprises a first non-conductive coating provided on the first rib, and the second isolation portion comprises a second non-conductive coating provided on the second rib.

3. The terminal module according to claim 1, wherein the first isolation portion comprises a first non-conductive film pasted on the first rib, and the second isolation portion comprises a second non-conductive film pasted on the second rib.

4. The terminal module according to claim 1, wherein the first isolation portion comprises a first non-conductive film pasted on the fixing portion of the first ground terminal, and the second isolation portion comprises a second non-conductive film pasted on the fixing portion of the second ground terminal.

5. The terminal module according to claim 1, wherein the first isolation portion comprises a first non-conductive isolation block located between the first ground terminal and the first rib, the second isolation portion comprises a second non-conductive isolation block located between the second ground terminal and the second rib, and the first non-conductive isolation block and the second non-conductive isolation block are integrally formed with the insulating member.

6. The terminal module according to claim 1, wherein a plurality of the first ribs are provided and discontinuously disposed along an extension direction of the fixing portion of the first ground terminal, and a plurality of the second ribs are provided and discontinuously disposed along an extension direction of the fixing portion of the second ground terminal.

7. A terminal module, comprising:

an insulating member;

a plurality of conductive terminals, each conductive terminal comprising a fixing portion fixed to the insulating member and a mating portion extending beyond the insulating member, the plurality of conductive terminals comprising a group of signal terminals, a first ground terminal and a second ground terminal, wherein the first ground terminal and the second ground terminal are both adjacent to the group of signal terminals, and wherein the group of signal terminals are located between the first ground terminal and the second ground terminal; and a conductive plastic mounted to the insulating member;

wherein the terminal module comprises a first rib, a second rib, and a groove located between the first rib and the second rib; the first rib corresponds to the fixing portion of the first ground terminal, the second rib corresponds to the fixing portion of the second ground terminal, the groove corresponds to the fixing portions of the group of signal terminals; the first rib is so adjacent to but not in contact with the fixing portion of the first ground terminal that coupling is capable of occurring; and the second rib is so adjacent to but not in contact with the fixing portion of the second ground terminal that coupling is capable of occurring;

wherein the first rib and the second rib are provided on the conductive plastic;

wherein the fixing portion of the first ground terminal and the fixing portion of the second ground terminal are both at least partly exposed to the insulating member; the terminal module comprises a first isolation portion located between the first rib and the fixing portion of the first ground terminal, and a second isolation portion located between the second rib and the fixing portion of the second ground terminal; and wherein the first isolation portion comprises a first non-conductive coating provided on the first rib, and the second isolation portion comprises a second non-conductive coating provided on the second rib.

8. A backplane connector, comprising:

an insulating portion; and a plurality of terminal modules, each terminal module comprising:

an insulating member comprising a mating surface and a mounting surface;

a plurality of conductive terminals, each conductive terminal comprising a fixing portion fixed to the insulating member, a mating portion extending beyond the mating surface, and a mounting foot extending beyond the mounting surface, the plurality of conductive terminals comprising at least a group of signal terminals, a first ground terminal and a second ground terminal, wherein the first ground terminal and the second ground terminal are both adjacent to the group of signal terminals, and wherein the group of signal terminals are located between the first ground terminal and the second ground terminal; and a conductive plastic mounted to the insulating member;

wherein each terminal module comprises a first rib, a second rib, and a groove located between the first rib and the second rib; the first rib corresponds to the fixing portion of the first ground terminal, the second rib corresponds to the fixing portion of the second ground terminal, the groove corresponds to the fixing portions of the group of signal terminals; the first rib is adjacent to the fixing portion of the first ground terminal but not in contact with the fixing portion of the first ground terminal; and the second rib is adjacent to the fixing portion of the second ground terminal but not in contact with the fixing portion of the second ground terminal; and wherein the insulating portion defines a plurality of receiving grooves to receive the mating portions, and two adjacent terminal modules are symmetrically disposed along a plane located between the two adjacent terminal modules; and wherein each insulating member comprises at least one holding portion, and the backplane connector comprises a holding piece for fixing the holding portions of all the terminal modules.

9. The backplane connector according to claim 8, wherein the first rib and the second rib are disposed on the conductive plastic.

10. The backplane connector according to claim 9, wherein the fixing portion of the first ground terminal and the fixing portion of the second ground terminal are both at least partly exposed to the insulating member; the terminal module comprises a first isolation portion located between the first rib and the fixing portion of the first ground terminal, and a second isolation portion located between the second rib and the fixing portion of the second ground terminal.

11. The backplane connector according to claim 10, wherein the first isolation portion comprises a first non-conductive coating provided on the first rib, and the second isolation portion comprises a second non-conductive coating provided on the second rib.

12. The backplane connector according to claim 10, wherein the first isolation portion comprises a first non-conductive film pasted on the first rib, and the second isolation portion comprises a second non-conductive film pasted on the second rib.

13. The backplane connector according to claim 10, wherein the first isolation portion comprises a first non-conductive film pasted on the fixing portion of the first ground terminal, and the second isolation portion comprises a second non-conductive film pasted on the fixing portion of the second ground terminal.

14. The backplane connector according to claim 10, wherein the first isolation portion comprises a first non-conductive isolation block located between the first ground terminal and the first rib, the second isolation portion comprises a second non-conductive isolation block located between the second ground terminal and the second rib, and the first non-conductive isolation block and the second non-conductive isolation block are integrally formed with the insulating member.

15. The backplane connector according to claim 9, wherein a plurality of the first ribs are provided and discontinuously disposed along an extension direction of the fixing portion of the first ground terminal, and a plurality of the second ribs are provide and discontinuously disposed along an extension direction of the fixing portion of the second ground terminal.

* * * * *